United States Patent [19]

Verch

[11] 4,408,650

[45] Oct. 11, 1983

[54] ROLL-DOWN WINDOW INSULATION

[75] Inventor: John T. Verch, Rice Lake, Wis.

[73] Assignee: Nichols-Homeshield, Inc., Aurora, Ill.

[21] Appl. No.: 366,525

[22] Filed: Apr. 8, 1982

[51] Int. Cl.[3] ..... E06B 9/08

[52] U.S. Cl. ..... 160/121 R; 160/269; 160/272

[58] Field of Search ..... 160/120–122, 160/269–273

[56] References Cited

U.S. PATENT DOCUMENTS

| | | | |
|---|---|---|---|
| 2,564,770 | 8/1951 | Spencer | 160/271 |
| 4,344,473 | 8/1982 | Shore | 160/121 R |
| 4,369,827 | 1/1983 | Anderson | 160/269 |

*Primary Examiner*—Peter M. Caun

*Attorney, Agent, or Firm*—McWilliams, Mann, Zummer and Sweeney

[57] ABSTRACT

This invention relates to an insulating device to be mounted at the inner side of an existing window and includes a plurality of spaced apart film curtains mounted on a roller at the top and having a rigid bar at the bottom adapted to run in channel shaped side tracks, with compressible sealing members in the track that are displaced by passage of the rigid bar and which then spring back to engage the marginal portions of the respective film curtains to press them against the side walls of the tracks to provide a sealed unit effectively sealing the side edges of the curtains against the circulation of air at these points.

3 Claims, 6 Drawing Figures

FIG. 1
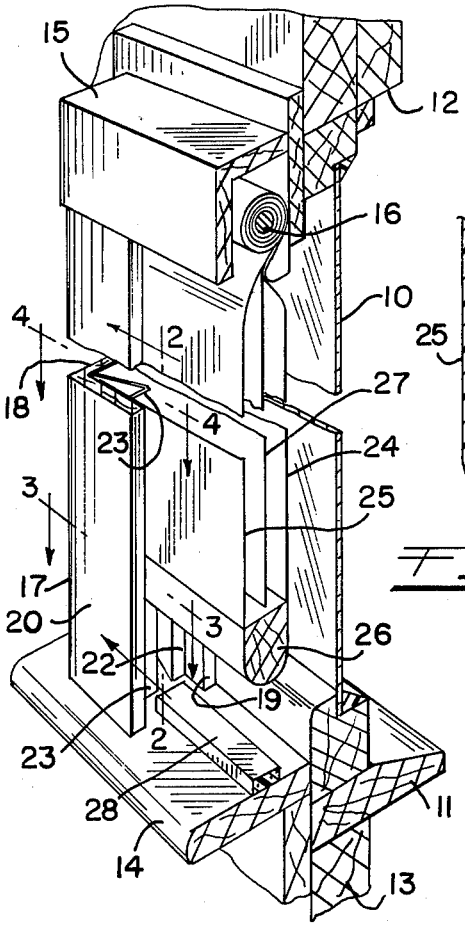
FIG. 2
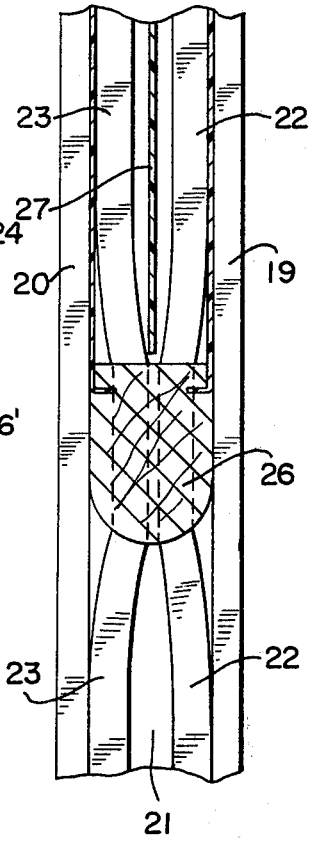
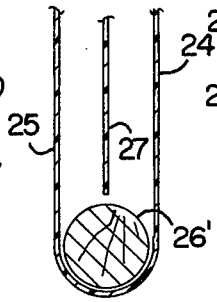
FIG. 5
FIG. 3
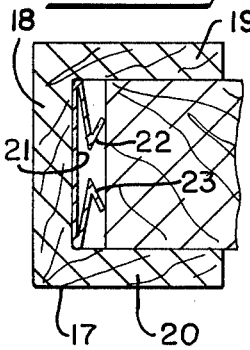
FIG. 4
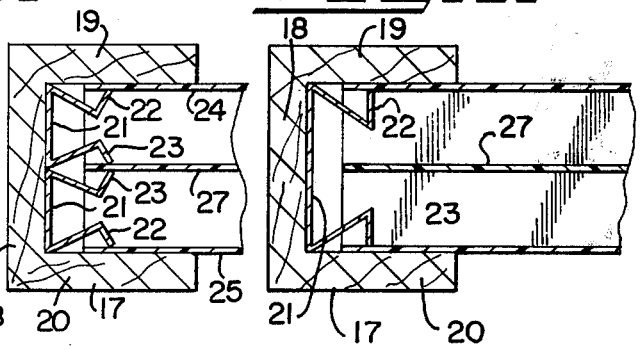
FIG. 6

ROLL-DOWN WINDOW INSULATION

BACKGROUND OF THE INVENTION

1. Field of the Invention

This invention lies in the field of those devices intended to provide window insulation against heat transmission in the glass areas, whether it be radiant transmission, convective transmission or conductive transmission.

2. Description of the Prior Art

Window insulating devices have been provided heretofore utilizing a plurality of films to be mounted at the inner side of a window and some of these have been roller mounted so that they could be pulled down at the inner side of a window to provide multiple air spaces to reduce heat flow in the window area and thus, depending upon the effectiveness of the unit, to cut down on the heat loss. However, many of these devices were not effectively sealed at the side edges and consequently air circulation occurred at these locations and adversely affected the efficiency of the insulating quality of such devices.

Some such devices did have sealing members at the side edges but these seals were fixed in position along the vertical edges of the window to engage the vertically movable films at all times and thus were subject to abrasion, especially where such seals were made from plastic materials. The seals were flexible and supposedly having a high elastic memory but with use and age, the seals lost their recuperative elastic properties and became ineffective so that the installation leaked at these side edges and permitted air circulation into the dead air space between the films and thus reduced the insulating effectiveness of the entire installation.

Prior patent art disclosing various window insulating arrangements comprise U.S. Pat. Nos. 2,306,086, Smith; 2,140,049, Granel; 2,328,257, Butts; 2,865,446, Cole; 2,247,634, Hornston; 2,361,762, Glenn et al.; 4,039,019, Hopper and 4,194,550, Hopper.

The present device does not require film separators as in the arrangement of Hopper patent 4,194,550 and therefore reduces the diameter of the curtain in the rolled-up condition.

This arrangement also will cause the film to reengage with the tracks at the sides if by some chance the film may accidentally become disengaged from one or both tracks. By actuating the curtain to the rolled-up condition and then pulling it down, the film engagement operation starts over with the film properly engaging the tracks.

SUMMARY OF THE INVENTION

This invention relates to a roll-down type of insulating device for mounting at the inner side of existing windows for the purpose of reducing heat transmission in the window area. The device includes spaced apart film curtains mounted on a roller at the top and having a rigid bar, or rail, across the bottom edge which is adapted to actuate flexible sealing members in tracks at the side edges of the film curtain to enable the films to enter behind the sealing members which then engage the respective films and press them against the opposite side walls of the pair of side mounted tracks.

The respective tracks are of channel section and each contain a pair of flexible sealing members that are compressed by passage of the rigid bar, or bottom rail, to open a space between the track side wall at each side and the respective sealing member, so that the films may enter behind the seal member, after which the seal at each side of the track closes on the respective films to clamp the film against the track side wall and effectively seal the side edge of the film curtain against the circulation of air. This positive seal prevents moist air from passing through and condensing on the glass window, thus maintaining the deadair quality of the space between the films. The sealing devices are actuated by the rigid bar bottom rail as the film curtains are unrolled at the top and the bar is lowered in the guide tracks at the respective sides of the curtain.

The seals are compressed by the ends of the bar and caused to move away from the respective side walls of the channel shaped guide track at each side edge of the film curtain. This enables the films to enter the open space between each seal and the associated track side wall as the bar passes and then the seals, because of their flexibility and inherent memory, regain their normal position to thus press the films against the respective track walls and thereby seal the side edges of the film curtain against air leakage to prevent circulation of air currents to the dead air space between the film curtains.

The dead air space may be divided by means of an intermediate film curtain that serves as a baffle to interrupt the air circulation pattern that would develop between the two outer film curtains. This intermediate film is not sealed, or secured at the side edges, so that it comprises a floating barrier to air circulation and the transmission of temperature differences.

DESCRIPTION OF THE DRAWINGS

The arrangement of the invention in accordance with the foregoing structure as above set forth, is illustrated in the accompanying drawings, wherein FIG. 1 is a general perspective view, partly in section, showing the invention as applied to a typical window;

FIG. 2 is a vertical sectional view taken on the line 2—2 of FIG. 1, showing a section through the bottom rail of the insulating curtain with the multiple film panels also in section and the seal members deflected by the rail;

FIG. 3 is a horizontal sectional view on the line 3—3 of FIG. 1, in the area of the bottom rail, with the seals compressed;

FIG. 4 also is a horizontal sectional view taken on the line 4—4 of FIG. 1, showing the seals in normal position clamping the curtain films against the opposite side walls of the channel section guide track;

FIG. 5 is a fragmentary detail view of a bottom rail arrangement utilizing a roller about which the insulating films are engaged; and FIG. 6 is a detail sectional view similar to FIGS. 3 and 4 illustrating a modified installation of the sealing members engaging the two outer films and the intermediate film.

DESCRIPTION OF THE PREFERRED EMBODIMENT

The invention is disclosed herein as applied to a window of the type usually found in a building, or home, and as shown in FIG. 1, is applied at the inner side of the window for ready manipulation from the room or orifice where it is located. The window 10 may be of the fixed type as shown, or it may be comprised of various types of operating sash windows as typically used in average home construction. The window extends between a window sill 11 and a lintel 12 and is disposed within the area of the wall structure 13. An inner window sill 14 defines the lower extent of the window opening in which the window 10 is mounted and a housing 15 is mounted adjacent the top of the window opening for a roller 16 carrying the insulating device of this invention. A channel section track 17 extends downwardly from the housing 15 at each side of the window opening and terminates at the inside sill 14.

The tracks 17 are an important element of this arrangement and include a web portion 18 and inner and outer flanges 19 and 20 forming a channel shaped guideway at respectively opposite sides of the window opening. These tracks may be made of wood, plastic, or any suitable material. A weatherstripping, or seal forming structure 21 is mounted at the inner side of the web 18 between the flanges 19 and 20. This may be formed of a thin and flexible metal strip or plastic and which includes generally L-shaped seal members 22 and 23 in relative association with the respective inner and outer flanges 19 and 20 of the channel section track 17. These seals are designed to be flexed between normal positions indicated in FIG. 4 and the compressed, or deflected, positions illustrated in FIG. 3 and then spring back to the normal position. The seals 22 and 23 are made of metal, or a suitable plastic material, such as thin bronze strips having the ability to flex, or be deflected and spring back to a predetermined condition that is normal.

The invention incorporates a multiple film curtain panel extending over the entire window area comprised of an inner film 24 and an outer film 25 that are spaced apart to form a dead-air space therebetween. These films are mounted at the top on the roller 16 whereby they are capable of being retracted by rolling them up on the roller. The film panels operate vertically in the opposite side tracks 17 and are engaged at their bottom ends about a bar, or bottom rail 26', by means of which the insulating curtain formed by the spaced films 24 and 25 can be raised and lowered in the side tracks 17. The films 24 and 25 may be continuous around the bottom rail 26', as shown in FIG. 5, which allows a differential motion between the rail and the film. This bottom rail is round and rolls to some extent when the insulating curtain is pulled down. The bottom rail may be formed as indicated at 26 with a flat top and rounded bottom, as best shown in FIG. 2 and the films secured thereto. The curtain films and the bottom rail extend into the opposite tracks and are adapted to slide up and down in the tracks.

A foam type block 28, as shown in FIG. 1, is mounted on the window sill 14 and extending entirely across the sill between the opposite tracks 17 and in position to be engaged by the bottom rail 26, or 26', when the insulating curtain shield is pulled down to its lowered position, thus effectively sealing this point against the entry of moist air, or the like, to the window 10.

The respective film panels normally are in engagement with the track side wall flanges 19 and 20 and in this position are clamped against the opposite flanges by the spring action of the seals 22 and 23 with the films being disposed in these positions at all times as shown in FIG. 4, when in the lowered position covering the window 10, to act as an insulating barrier. It is the bottom rail 26 running in the tracks 17, that deflects and compresses the two seal members 22 and 23 as the curtain panel is lowered to enable the films 24 and 25 to enter behind the seal members to be clamped against the track flanges, or side walls, where they are secured throughout the full height of the window when the curtain films are disposed in their lowered position.

The action of the bottom rail 26 on the seal members 22 and 23 is best illustrated in FIGS. 2 and 3 where it will be seen that the rail deflects and compresses the seal members to cause them to move away from the flanges 19 and 20, whereupon the films feed into the spaces between the deflected seals and the flanges and as the rail passes, the seals spring back to clamp the films against the inside surfaces of the flanges. This is a continuous operation as the film curtain is moved downwardly with the bottom rail and when the rail and film panels are raised, the operation is reversed so that when the rail 26 is in its fully raised position the seals are deflected at the top for entry of the films at the start of the downward operation.

It will be noted that an intermediate film 27 is provided between the films 24 and 25 and this film comprises a low emittance, rated at approximately 0.1, acting as a radiation barrier and preventing infra red rays from being passed through, is for the purpose of dividing the dead air space between the films and act as a baffle against the development of a pattern of air circulation that might develop between the two film panels as a result of thermal transmission. The intermediate film 27 is not sealed, or secured, at any of its edges, but floats freely in the intermediate position and acts as a floating barrier to the transmission of temperature differences that may have the effect of setting up an air circulation within the dead air space. More than one intermediate film may be utilized and may be of the same, or different materials, serving different purposes. One may act to reflect heat back into the room, while another acts to reflect incoming light to the outside.

The operation of this insulating shield is as follows: When the bottom rail 26 is moved downwardly carrying the films with it, the rail and the film operate within the side tracks 17 and as the rail travels in this downward direction, it deflects and compresses the seals 22 and 23 to move them away from the inner surfaces of the track flanges 19 and 20 to thereby open a space for each film, into which such films continuously feed as the rail continues to move downwardly. As the rail passes, the seals spring back to press the two outer film panels against the inner surfaces of the opposite track flanges and thereby effect a positive seal along the side edges of the insulating film curtain. The intermediate film panel 27 meanwhile floats freely between the two outer sealed film panels to increase the insulating efficiency of the roll-down shield thus formed.

As shown in FIG. 6, the intermediate film 27 may also be sealed along its opposite side edges in a manner similar to the films 24 and 25. Multiple sealing members 21 may be mounted in the channel shaped tracks 17 between flanges 19 and 20 with flanged portions 22 positioned to engage and seal the films 24 and 25 against the flanges 19 and 20 just as in the previously described arrangement. The multiple sealing members 21 include flanged portions 23 disposed in opposed relation and positioned to engage the side edge of the intermediate film 27 therebetween and thus seal the respective side edges of this film.

CONCLUSION

From the foregoing, it can be seen that an insulating arrangement for existing windows has been provided wherein a multiple film curtain structure is top mounted on a roller and is capable of being drawn downwardly in channel-shaped tracks at opposite side edges thereof with flexible sealing device in the respective tracks adapted to be actuated by a rigid bottom bar on the curtain structure whereby the seals are caused to open for entry of the curtain films behind the sealing members which then close on the films to press them against the side walls of the respective tracks and thereby tightly seal the side edges of the curtain structure.

What is claimed is:

1. A window insulating multiple film curtain installation comprising a top mounting roller for the film curtain, a rigid bottom bar for the film curtain, said curtain including at least two films spaced apart and secured at the top to the roller and at the bottom engaged with said bar, a guide track at each side edge of the film curtain, each track having opposite guide walls, said film curtain operating vertically in said guide tracks, and a pair of flexible sealing members in each of said guide tracks for association with the respective films, said sealing member being deflected by said rigid bar as the film curtain is moved downwardly in said tracks with the films entering behind the deflected sealing members as the bar passes and then pressed by the sealing member against a guide wall of the track, at least one intermediate film disposed between said two films and which floats freely between said sealing members.

2. A window insulating multiple film curtain installation comprising a top mounting roller for the film curtain, a rigid bottom bar for the film curtain, said curtain including at least two films spaced apart and secured at the top to the roller and at the bottom engaged with said bar, a guide track at each side edge of the film curtain, each track having opposite guide walls, said film curtain operating vertically in said guide tracks, and a pair of flexible sealing members in each of said guide tracks for association with the respective films, said sealing members being deflected by said rigid bar as the film curtain is moved downwardly in said tracks with the films entering behind the deflected sealing members as the bar passes and then pressed by the sealing member against a guide wall of the track, said guide track of channel-shaped section and said sealing members are mounted in the bight of the channel and adapted normally to press against opposite side wall flanges of the channel.

3. A window insulating installation as set forth in claim 2 wherein each guide track includes sealing members adapted to press against the side wall flanges of the channel and additional sealing members adapted to clamp against said intermediate film.

* * * * *